United States Patent [19]

Peck et al.

[11] 4,100,490

[45] Jul. 11, 1978

[54] ELAPSED TIME INDICATOR AND ELECTROLYTIC TIMER CELL

[75] Inventors: David B. Peck; Vincent T. Guntlow; Paul H. Netherwood, all of Williamstown, Mass.

[73] Assignee: Diametrics, Inc., Williamstown, Mass.

[21] Appl. No.: 776,517

[22] Filed: Mar. 11, 1977

[51] Int. Cl.[2] ..... G04F 8/00

[52] U.S. Cl. ..... 324/182; 324/94

[58] Field of Search ..... 324/94, 30 A, 182, 30 R

[56] References Cited

U.S. PATENT DOCUMENTS 3,355,731 11/1967 Jones Jr. ..... 324/182

3,387,288 6/1968 Bissett et al. ..... 324/182

*Primary Examiner*—M. Tokar

*Attorney, Agent, or Firm*—Arthur K. Hooks

[57] ABSTRACT

An elapsed time indicator includes an electrolytic timing cell in series connection with a resistor, which series circuit may be connected to a D.C. voltage. The cell is comprised of an aluminum can containing a liquid electrolyte with an aluminum anode immersed therein. During operation an aluminum oxide film is grown on the surfaces of the anode, the film thickness and resistance increasing with time. The voltage dropped across the cell of any instant is employed as an indication of the accumulated elapsed time during which the D.C. voltage has been connected to the circuit.

21 Claims, 4 Drawing Figures

ELAPSED TIME INDICATOR AND ELECTROLYTIC TIMER CELL

BACKGROUND OF THE INVENTION

This invention relates to elapsed time indicating devices and more particularly is concerned with a simple electrochemical timing cell which utilizes electrical current to anodize an electrode.

The prior art contains many examples of devices for measuring elapsed time by electrochemical means. One such system, such as described in U.S. Pat. No. 3,564,347 issued Feb. 16, 1971, employs dissimilar metal electrodes separated by an electrolyte which supports plating and/or deplating of ions at one of the metals. When one electrode is completely deplated with the metal of the other electrode, an electrochemical couple or voltage appears.

Another system providing a visual indication of elapsed time (offered by the Fredericks Company, Huntingdon Valley, Pa.) depends upon the plating out of copper ions from an electrolyte in a capillary tube as a function of current flow between anode and cathode.

Still another system, described in U.S. Pat. Nos. 3,045,178 issued July 17, 1962, and 3,665,308 issued May 23, 1972, provides a visual indication of elapsed time through the plating and deplating of two columns of mercury in a capillary tube separated by a small amount of electrolyte (a so-called gap) as a function of current flow.

These prior systems, while effective in certain applications, suffer from certain disadvantages. The dissimilar metal "switching" coulometers normally require expensive noble or rare metal elements and ions and are only suitable for indicating a specific "time-out" period—intermediate periods of time are not identifiable.

All of these systems depend upon the plating out of metallic ions.

It is an object of this invention to overcome the defects of prior elapsed time indicating devices.

It is a further object of this invention to produce a simple and low-cost elapsed time cell.

It is a still further object of this invention to provide an electrolytic cell that is capable of a continuous indication of elapsed time.

It is another object of this invention to provide a simple low-cost elapsed time indicator system.

It is yet another object of this invention to provide a low-cost elapsed time indicator system suitable for use in automobiles and other engine powered vehicles having a low voltage (e.g. 6 volt or 12 volt battery) source of electrical energy, which vehicles require special service maintenance at periodic running intervals.

SUMMARY OF THE INVENTION

An elapsed time indicating cell comprises a valve metal anode, a cathode being separated from the anode by a space, an electrolyte occupying the space, and a housing containing the electrolyte.

A series electrical circuit is formed including a resistor and the cell. The series circuit is terminated by two power supply terminals. A voltage sensing means is connected across the cell for producing a signal that is a function of the total time during which a D.C. power supply has been connected to the power supply terminals.

The invention recognizes the principle that an electrolytic cell having a valve metal anode is capable of exhibiting a changing impedance that is a function of the total electrical charge that has passed through it. It is further recognized that the cell may be connected in series with a resistor and a D.C. power supply causing the impedance of the cell to change as a function of the total time of energization. The larger the total time of energization, the greater becomes the resistance of the cell to D.C. current while simultaneously the capacitance decreases (capacitive reactance increases). Either or both of these impedance changes may be used to indicate the elapsed time of energization.

The invention is based upon the use of coulometric reaction energy required to anodize (oxidize) so-called valve metals by the process well known in the electrolytic capacitor art. However, in contrast to the latter, wherein the anode material is oxidized to an essentially fixed voltage level (20 to 500% higher than the capacitor operating voltage level), the present invention relates to a device in which the anode is not formed prior to use (other than a nominal initial voltage in some instances) and in which the device is "exhausted" prior to achieving a stable anodization voltage plateau.

The anodizable electrode should consist of a so-called valve metal selected from aluminum, titanium, niobium, vanadium, and tantalum. Tantalum and aluminum are preferred electrode materials since the electrolytically formed oxide layer is most stable, especially considering the "off-voltage" periods which characterize many of the applications of the invention. Aluminum is especially preferred because of its relatively low cost.

Anodic films formed on valve metal anodes for use as the dielectric films in electrolytic capacitors are as a practical matter assigned a maximum operating voltage that is from about 0.8 to 0.2 times the voltage at which they were formed. This insures an acceptably low leakage current in operation. Furthermore, the smaller factors are chosen for the smaller maximum rated operating voltages. For a rated operating voltage of 2 volts, for example, the anode formation voltage would typically be chosen to be at least as great as 4 volts and as high as 20 volts for very high quality capacitors.

For a given anode surface area, the CV product and the loss factor, tan $\delta$, remain essentially constant as the formation voltage changes over a wide range, e.g. 10 volts to 300 volts. C is the capacitance. V is the rated maximum operating voltage. V is assumed for this purpose to be a fixed fraction of the formation voltage. Low formation voltages are desirable for maximizing the capacity. However, at low formation voltage, generally under about 10 volts, the CV product decreases and the tan $\delta$ goes up as the formation voltage decreases further. Thus, in this low voltage region of formation voltages the efficiency and quality of capacitors so formed being operated at any voltage tends to become very poor.

It is thus universally known in the electrolytic capacitor art to employ anode formation voltages greater than 3 volts regardless of the desired maximum rated operating voltage. The thickness of anodically formed aluminum oxide films is about from 11A/volt to 13A/volt while for tantalum oxide it is from 12A/volt to 20A/volt. Since no known electrolytic capacitors are formed at less than 3 volts there are no known capacitors having anodically formed dielectric films on their anodes which films are less thick than about 30 angstroms.

The anodes of an elapsed time indicating cell of this invention are preferably preformed prior to their assembly into the cell housing, but may be formed after assembly of the cell components. However, in use the indicating cell is subsequently further formed at a very slow rate during operation. The rate of formation during operation of cells of this invention expressed in volts per hour, are preferably no greater than 0.5 volts per hour whereas electrolytic capacitors are typically formed as much greater rates, namely greater than 5 volts per hour. The associated high rate of gas generation is not a problem since capacitor anodes are formed in operations prior to capacitor assembly.

The slow rate of formation during operation of a cell of this invention makes it possible for the low molecular weight gasses, mainly hydrogen, to diffuse through the sealing members of the cell at a rate commensurate with its slow generation in formation and to minimize internal pressures that may rupture the seal or housing.

It is preferred to provide an initial anodic film of a thickness corresponding to a formation voltage of about 2 volts in order to provide a more linear relationship between the elapsed time and the impedance of the cell (or the voltage drop across the cell). The initial thin anodic film has the additional advantage that the above-noted relationship is more uniform and predictable from cell to cell, since the initial film masks differences that may exist in the anode surfaces from cell to cell such as the degree of air oxidation and damage to the air oxidation film caused in handling.

Thus, an important structural feature of the electrolytic cell of this invention is an anodically grown film on the anode having a thickness corresponding to a formation voltage of less than 3 volts. In general, however, no anodic film need be provided at all.

For small area anodes of this invention, a machined or formed rod may be suitable, while for somewhat larger areas, a coiled wire anode or woven screen anode is useful. Where very large areas are desired, the surface of a foil or plate may be etched using known technology. Surface area increases on the order of 50 to 500 times the geometrically measured area may thus be achieved. A porous sintered anode may also be employed.

The cathode or opposing electrode, in the case of a D.C. timing cell should advisably have an equivalent area at least that of the anode area to reduce gassing and series capacitance effects. The cathode may be selected from a material exhibiting minimal polarizing effects, or depolarized, as for example a silver cathode with a platinized surface. In accordance with a limited embodiment of the invention, an aluminum cathode is employed with an effective surface area at least equal to that of the anode and may be preanodized to the same level as that of the anode, or to a higher voltage, although this effects a reduction in the effective capacitance of the cell.

If the current used to anodize the electrode(s) is of sufficient magnitude, the cell may be used directly to illuminate (activate) a lamp, a light-emitting diode, or any other visual indicator. Ordinarily, if the time to be measured is more than a few hours, for example, and the visual indicator connected in parallel with the cell is an incandescent filament bulb which is rated at 8 volts and draws 20 milliamperes, the cell should have a substantial electrode area, which may be accomplished by etching the surface thereof. In this system and example the visual indicator will gradually illuminate, as the cell voltage approaches 8 volts, thus giving a warning of the approaching of the time to be counted.

According to another embodiment of the invention, the series resistor, between the energy source and the timing cell, consists of a visual indicator, such as an incandescent lamp filament or a light-emitting diode rated at or slightly less than the voltage level of the energy source. During the period that the series resistance of the timing cell is low, owing to the anodization reaction therein, the series resistor-lamp will be illuminated, finally reducing its light output in accordance with the time design of the cell.

In accordance with another embodiment of the invention, the anode electrode material may comprise a thin evaporated layer of the valve metal, such as aluminum, on a carrier, typically a smooth plastic film of polyethylene terephthalate, regenerated cellulose, polycarbonate, or other materials which are stable in the process of the electrolyte. When using a thin evaporated film the thickness thereof should be greater than the thickness of metal oxidized during the timing operation in order to prevent discontinuities in electronic conduction to the terminal of the seal. Regenerated cellulose, as contrasted to the other referenced films, will absorb a glycol based electrolyte, thus permitting the oxidation to thick plates on both sides of the electrode surface. In such instances, it is preferred that the thickness of the metal be at least twice that amount to be oxidized.

In accordance with a limited embodiment of the invention, a reversible timing cell is produced wherein two anodes of normally equal surface area are employed instead of an anode and cathode element. In this construction the timing cell is reversible. After timing to a desired voltage level with one electrode connection as the anode, the terminal connections may be reversed and the cell operated in the reverse direction. This provides a dual timing function, although the cell still must be discarded after the second timing operation.

The elapsed time indicator of this invention, when connected through the ignition switch to, for example, an automobile battery, will advantageously provide a very low cost cumulative running time indicator, signaling the appropriate time for oil changes, tire rotation, and other maintenance service. It is particularly important that the preformation of the anode be less than 3 volts in such applications wherein the energizing voltage is low (e.g. a 12 volt auto battery), so that the potential time for the virgin cell to reach the predetermined alarm or indicating voltage (less than 80% of 12 volts) is still adequate.

DESCRIPTION OF THE PREFERRED EMBODIMENT

Figure 1:
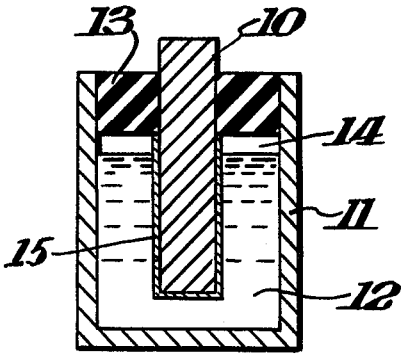
FIG. 1 shows a cross-section of a simple timing cell of the invention.

Referring more particularly to FIG. 1, 10 is the metallic anode metal of the timing cell. It is selected from the class of metals known as valve metals which when connected to the positive polarity terminal of a current source and in intimate contact with an oxidizing electrolyte will become anodized or "formed" on its exposed surface to form a dielectric layer whose barrier characteristics inhibit the flow of current to the anode, and which dielectric layer provides capacitance between the anode and the electrolyte/cathode elements. Aluminum is our preferred anode material, although other metals of the class, such as tantalum and niobium may be employed. Aluminum and tantalum are especially valuable owing to the stability of the formed dielectric even on periods of remaining "off" voltage.

The metallic cathode 11 also serves as a container for the electrolyte 12. While many metals may be used, we prefer to use aluminum if the anode is aluminum. With tantalum anodes, a platinized silver cathode is effective. The effective area of the cathode preferably should be at least as great as the effective area of the anode although the system will operate, though with less absolute accuracy if the effective area is less.

When current flows in the cell, the electrolyte material 12 will oxidize the surface metal of the anode 10. Suitable formation electrolytes vary with the metal selected as the anode in order to provide a stable oxide film. For aluminum anodes, an electrolyte based on the borate anion, such as ammonium pentaborate, dissolved in an alcohol and/or water, such as ethylene glycol, is an excellent system. For tantalum, more active electrolytes can be used as tantalum is not as subject to corrosive action. Sulfuric acid, for example, may be used.

The seal 13 retains electrolyte within the cell. It consists of an insulating material such as glass, ceramic, plastic, or rubber. If a hermetic seal is desired, glass and ceramic are preferred, but must be chemically bonded to the metallic anode and cathode. More commonly, rubber—under compression—is used for the seal; it will permit the passage of low molecular weight gas, such as the hydrogen which is evolved on the surface of the cathode during the formation or anodizing process.

The gas pocket 14 is desirable as a cushion which can be compressed as additional gas is generated during the anodizing process. It is a feature of this invention that the pressure of this gas pocket should be less than that required to rupture the seal during the timing operation. At the time of sealing the timing cell, the gas may comprise air (nitrogen, oxygen, and carbon dioxide), or, preferably, an oxygen-free atmosphere to prevent preoxidation of the anode.

Figure 2:
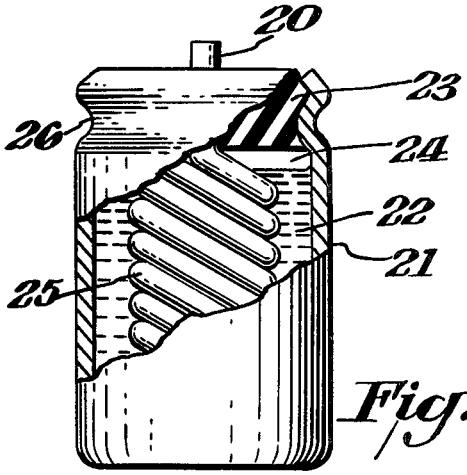
FIG. 2 shows a partial cross-section of one of the preferred embodiments of the invention.

FIG. 2 shows a preferred embodiment of the timing cell of this invention (and one on which the examples following are based). In this figure 20 represents a wire of aluminum formed into a helical shape 25 to provide a substantial anode surface. Twenty-one is an aluminum can (cathode) which may be etched on its inside surface to increase the surface area, especially if the anode wire surface has been etched to increase its effective surface area.

The anodizing electrolyte 22 is contained in cathode can 21 by means of rubber seal 23. The gas pocket is shown as 24.

In order to achieve a seal free from the possibility of electrolyte 22 leakage, the rubber bung 23 is compressed around anode 20 through deformation of the can 21 into a bead or depression thereof, referred to as 26.

Figure 3:
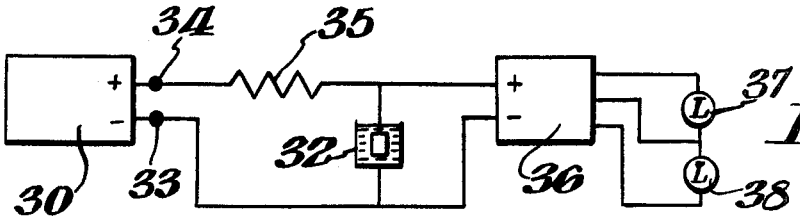
FIG. 3 shows a schematic representation of an elapsed time indicator of this invention.

Referring to FIG. 3, 30 represents a D.C. power source, such as a battery connected to timing cell 32 at terminals 33 and 34 through a fixed resistor 35, which resistor although shown in the positive side of the circuit could be on the negative side. A sensing means 36 such as a C-MOS buffer/driver integrated circuit (RCA Type CD-4049B being typical) which can switch on or off at a particular voltage level appearing across timing cell 32. In the figure, lamp 36 will be ignited ("on") if the voltage across the cell 32, from voltage/current source 30, is 65% of source 30. If cell voltage exceeds 65% of source 30, lamp 38 is illuminated and lamp 37 is "off".

Alternately, the voltage sensing means 36 may simply be a lamp or preferably a volt meter providing a continuous indication of elapsed time.

Figure 4:
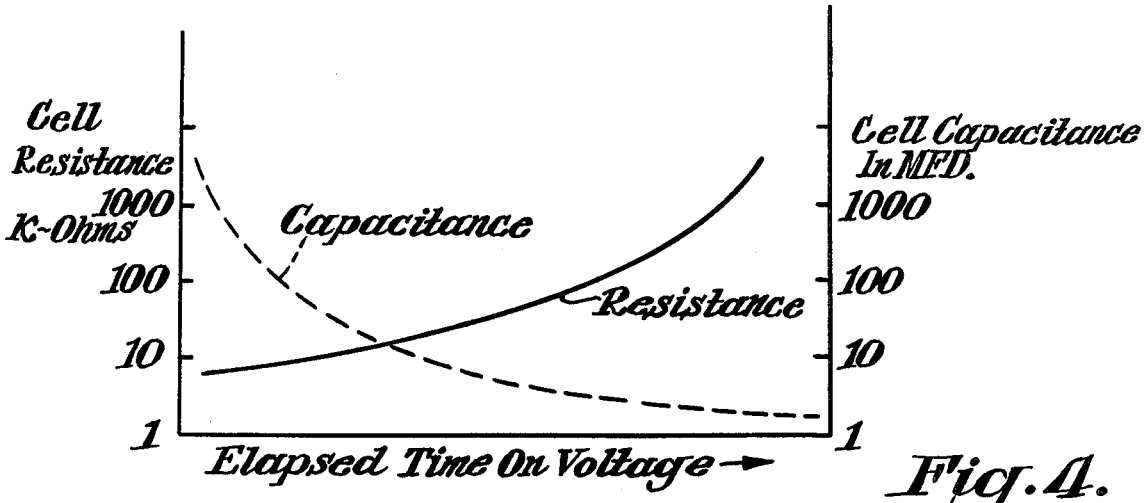
FIG. 4 shows representative curves indicating the relative magnitude of change of cell resistance and capacitance as a linear function of time that the cell is connected to a fixed voltage power supply in the circuit illustrated in FIG. 3.

FIG. 4 indicates the typical characteristics apropos resistance and capacitance of a cell of the invention (voltage characteristics being shown in the examples which follow). In this figure, cell resistance and capacitance values are shown on log scale against elapsed time on voltage. Typically, cell resistance which comprises the series resistance of the electrolyte and the dielectric oxide or other anodized film on the anode will increase by one, two, or more orders of magnitude as the source voltage level is approached.

Cell capacitance, normally very high on "virgin" or cleaned anode metal surfaces, decreases rapidly as the anode surface is formed or anodized. While the effect is most pronounced at low anodizing voltages, it is also significant at voltages of 500 volts and higher (in the case of aluminum anodes).

From FIG. 4, it will be evident that the reduction in capacitance and/or the increase in resistance of the timing cell may be employed to trigger or "switch" various electronic/electrical devices such as a Schmitt trigger circuit to indicate a predetermined "time elapsed" from the onset of current flow.

While in FIG. 3 a series and current-limiting resistor has been shown, the timing cells of the invention are not dependent thereon. If an extended timing period is desired, such as 100 hours, and the energy source is a low impedance, high capacity battery, a series resistor is desirable to permit small timing cells. However, if the energy source provides a low and essentially constant source of current (as for example a radioactive battery) the series resistor may be eliminated. Such a source, however, may be considered equivalent to a hard voltage source in series with a resistor.

In the following examples, two operating electrolytes were employed, prepared, and identified as follows:

A. Twenty grams of ammonium pentaborate dissolved in 80 grams of ethylene glycol at 71° C.

B. Thirty grams of ammonium formate dissolved in 150 grams of ethylene glycol at 70° C.

Resistivities of these electrolytes were 320 ohm cm. and 31 ohm cm. at 25° C, respectively, and 1200 and 81 ohm cm. at 2° C, respectively.

For the examples in which the anode was preanodized prior to assembly in other than the operating electrolyte, the formation electrolyte consisted of 20 gms. of ammonium dihydrogen phosphate dissolved in 200 gms. of water.

Except where otherwise indicated, the cathode consisted of a can drawn from aluminum alloy No. 3003 which was given a hot washing in a phosphate detergent followed by a deionized water rinse and drying before use. These cans have an inner diameter of 0.5 inch.

Anode materials used in the examples are identified as follows:

Wire: 0.062 inch diameter 99.99% purity aluminum wire, wound in a helical coil of 0.25 inch inner diameter.

Foil: 0.003 inch thick 99.99% purity aluminum foil 1 ½ inches wide.

Met: 0.00035 inch thick polyethylene terephthalate film metallized with aluminum on one surface to a thickness corresponding to a resistance of 4 ohms per square.

The cell assembly consisted of dispensing electrolyte into the can, threading the lead portion of the anode through a tightly fitting hole provided therefor in a butyl rubber bung and compressing the open mouth of the can about the bung.

The power supply consisted of a 12 volt lead acid battery or a regulated low impedance D.C. power supply adjusted to a given output voltage corresponding to that of the lead acid battery; this voltage was 12.35 ± 0.15 volts.

The series resistors were fixed, stable film units with a resistance tolerance of 3% or better.

The performance data presented for each of the following experimental cells was accelerated by employing a relatively low value resistor in the series circuit. In most practical applications this resistor would have a value orders of magnitude greater. For a given cell and supply voltage a predetermined voltage level across the cell (e.g. 80% of the supply voltage) will be reached at an elapsed running time that is substantially proportional to the value of the resistor. Thus, the system is capable of indicating elapsed times of many thousands of hours if desired.

EXAMPLE 1

In this example, 20 inch long anodes were employed, utilizing operating electrolyte A and a can cathode. The anode of one cell was not preformed while the anode of another cell was preformed at 2.8 volts. The series resistor was 10,000 ohms in value. Cell voltages are given in Table I as a function of elapsed time.

Table I

| Elapsed Time (Minutes) | Control (Volts) | 2.8 VDC Pref-form (Volts) |
|---|---|---|
| 0.17 | 1.51 | 3.80 |
| 0.33 | 1.73 | 4.21 |
| 0.50 | 1.89 | 4.50 |
| 0.67 | 2.10 | 4.58 |
| 0.83 | 2.27 | 4.68 |
| 1.0 | 2.41 | 4.78 |
| 2.0 | 3.19 | 5.35 |
| 3.0 | 3.88 | 5.87 |
| 4.0 | 4.52 | 6.34 |
| 5.0 | 5.10 | 6.76 |
| 6.0 | 5.61 | 7.16 |
| 7.0 | 6.10 | 7.51 |
| 8.0 | 6.53 | 7.83 |
| 9.0 | 6.92 | 8.14 |
| 10.0 | 7.28 | 8.41 |

EXAMPLE 2

In this example for which data is given in Table II, 10 inch long coiled wire anodes were employed with electrolyte A and a cathode can, using a 147,000 ohm series resistor. The anodes were not preformed. The continuous unit was left on voltage at all times; the intermittent unit was subjected to voltage for ten minutes alternated with ten minutes of no voltage. Cell voltage readings are shown, indicating the lack of dependence on continuous exposure to voltage. "Off" periods of 24 hours or more appear to make no significant difference.

Table II

| Elapsed Time (Minutes) | Continuous (Volts) | Intermittent (Volts) |
|---|---|---|
| 10 | 3.14 | 3.15 |
| 30 | 4.50 | 4.49 |
| 50 | 5.42 | 5.40 |
| 70 | 6.13 | 6.13 |
| 90 | 6.69 | 6.72 |
| 110 | 7.26 | 7.32 |
| 130 | 7.74 | 7.82 |

EXAMPLE 3

Cells of this example included a 10 inch long foil anode and electrolyte A. A 22,000 ohm resistor was employed.

Table III

| | Elapsed Time in Minutes | | | | | | |
|---|---|---|---|---|---|---|---|
| Cell Voltage: | 3.0 | 4.0 | 5.0 | 6.0 | 7.0 | 8.0 | 9.0 |
| Anode Treatment | | | | | | | |
| None | 1.5 | 3.2 | 6.1 | 10.0 | 14.5 | 20.0 | 27.3 |
| 5% NaOH wash | 2.9 | 4.5 | 6.7 | 9.2 | 12.0 | 16.9 | 23.0 |
| Electro-etched | 3.1 | 6.0 | 9.6 | 14.7 | 21.5 | 29.7 | 40.5 |

The above example demonstrates the substantial elimination of normal air formed surface oxide on the aluminum by caustic wash and the resulting "extra time" required for initial timing formation. Formation is more efficient, however, as evidenced by the acceleration in formation as the cell voltage approaches the power supply voltage.

The electro-etched anode was etched at a current of 200 milliamperes in a 10% solution of sodium chloride in water at 25° C for five minutes. The resulting increase in effective surface area in the timing cell substantially extended the time interval to reach different cell voltage levels.

EXAMPLE 4

In this example a 1 inch × 1 ½ inches piece of metallized polyethylene terephthalate anode was placed in a beaker with electrolyte A and an aluminum foil cathode of comparable size, the anode and cathode being separated by approximately 0.25 inch The series resistor was 10,000 ohms. Performance data is shown in Table IV.

Table IV

| Elapsed Time (Minutes) | Cell Voltage (Volts) |
|---|---|
| 0.17 | 2.35 |
| 1.0 | 4.65 |
| 2.0 | 6.48 |
| 3.0 | 7.83 |
| 4.0 | 8.83 |
| 5.0 | 9.57 |
| 6.0 | 10.12 |
| 7.0 | 10.54 |
| 8.0 | 10.85 |
| 9.0 | 11.09 |
| 10.0 | 11.28 |

EXAMPLE 5

In this example all anodes were 8½ inches in length and prewashed in 1% NaOH in water at 80° C for 2 minutes, rinsed in deionized water, and dried before further treatment. The cathode can was as described earlier and the power supply was set at 12.35 VDC with a 10,000 ohm resistor in series with the timing cell.

The anodes indicated as "etched" were subjected to two minutes at 90° C in 18.8% strength hydrochloric acid, then rinsed and dried before assembly into the test cell. Table V gives the elapsed time in minutes to reach various cell voltages.

Table V

| Anode | Electrolyte | 2.0 | 3.0 | 4.0 | 5.0 | 6.0 | 7.0 |
|---|---|---|---|---|---|---|---|
| Plain | A | 0.2 | 0.6 | 1.1 | 1.8 | 2.4 | 3.3 |
| Plain | B | 0.2 | 0.6 | 0.9 | 1.1 | 1.7 | 2.2 |
| Etched | A | 2.8 | 6.5 | 10.5 | 15.6 | 21.5 | 29.4 |
| Etched | B | 3.9 | 6.1 | 9.3 | 13.1 | 17.6 | 23.1 |

What is claimed is:

1. An elapsed time indicating cell comprising a valve-metal anode; a cathode being separated from said anode by a space; an electrolyte occupying said space; a housing containing said electrolyte; and an anodically formed oxide film overlying the surface of said anode, said film having a thickness corresponding to a formation voltage of less than 3 volts.

2. The cell of claim 1 wherein said corresponding formation voltage is about 2 volts.

3. The cell of claim 1 wherein said housing is a metal container serving as said cathode.

4. The cell of claim 1 wherein said anode is aluminum.

5. The cell of claim 1 wherein said cathode is aluminum and said electrolyte contains borate ions.

6. The cell of claim 1 wherein said anode is in the form of a coiled wire.

7. An elapsed time indicator comprising:

(a) an indicating cell comprising a valve metal anode, a cathode being separated from said anode by a space, an electrolyte occupying said space, an oxide film of said valve metal overlying the surface of said anode, said film having a thickness corresponding to a formation voltage of less than 3 volts, and a housing containing said electrolyte;

(b) a resistor having a series electrical circuit connection with said cell;

(c) two power supply terminals terminating said series circuit;

(d) a voltage sensing means for sensing the voltage across said cell and for producing a signal that is a function of the total time during which a D.C. power supply has been connected to said terminals.

8. The indicator of claim 7 wherein said housing is a metal container serving as said cathode.

9. The indicator of claim 7 wherein said anode is of aluminum.

10. The indicator of claim 9 wherein said cathode is of aluminum and said electrolyte contains borate ions.

11. The indicator of claim 7 wherein said corresponding formation voltage is about 2 volts.

12. The indicator of claim 7 wherein said anode is in the form of a coiled wire.

13. The indicator of claim 7 wherein said sensing means is an electronic circuit which includes a Schmitt trigger circuit.

14. The indicator of claim 13 wherein a Schmitt trigger circuit is connected to a lamp, the illumination of said lamp serving as said alarm signal.

15. The indicator of claim 7 wherein said sensing means is a lamp being directly connected in parallel with said cell.

16. The indicator of claim 7 wherein said sensing means is a voltmeter for continuously indicating the elapsed operating time of said system.

17. The cell of claim 1 wherein said thickness is zero.

18. The indicator of claim 7 wherein said thickness is zero.

19. An elapsed time indicator comprising:

(a) an indicating cell comprising a valve metal anode, a cathode being separated from said anode by a space, an electrolyte occupying said space, an oxide film of said valve metal overlying the surface of said anode, said film having a thickness corresponding to a formation voltage of less than 3 volts, and a housing containing said electrolyte;

(b) a resistor having a series electrical circuit connection with said cell;

(c) two power supply terminals terminating said series circuit;

(d) a capacitance sensing means for sensing the capacitance of said cell and for producing a signal that is a function of the total time during which a D.C. power supply has been connected to said terminals.

20. The cell of claim 1 wherein said valve-metal anode consists of a film having been metallized with aluminum.

21. The cell of claim 21 wherein said film is made of polyethylene terephthalate.

* * * * *